US005289906A

United States Patent [19]

Guidi

[11] Patent Number: 5,289,906

[45] Date of Patent: Mar. 1, 1994

[54] FOLDING BAG, PARTICULARLY TRAVELLING BAG

[75] Inventor: Pierino Guidi, Schieti di Urbino, Italy

[73] Assignee: Piero Guidi di Pierino Giuseppe Guidi & C. s.n.c., Pesaro, Italy

[21] Appl. No.: 923,597

[22] Filed: Aug. 3, 1992

[30] Foreign Application Priority Data

Sep. 3, 1991 [IT] Italy ..... MI91 U 000753

[51] Int. Cl.[5] ..... A45C 7/00; A45C 13/30; A45C 13/36

[52] U.S. Cl. ..... 190/107; 190/103; 190/127; 190/903; 383/2; 383/4

[58] Field of Search ..... D3/71, 76, 48; 190/107, 190/127, 103-105, 22, 21, 14, 15, 1, 901, 903; 383/2, 4; 150/106, 117

[56] References Cited

U.S. PATENT DOCUMENTS

| | | | |
|---|---|---|---|
| D. 157,266 | 2/1950 | Kiernan | D3/48 |
| D. 231,867 | 6/1974 | Ohyama | D3/48 |
| D. 282,602 | 2/1986 | Allen | D3/71 |
| D. 283,465 | 4/1986 | Allen | D3/71 |
| D. 284,425 | 7/1986 | Allen | D3/71 |
| 1,983,036 | 12/1934 | Kaufmann | 190/901 X |
| 2,038,319 | 4/1936 | Stanley | 190/901 X |
| 2,105,319 | 1/1938 | Hedden et al. | 383/4 X |
| 2,167,926 | 8/1939 | Glasker | 383/4 X |
| 2,532,778 | 12/1950 | Mintzes | 383/4 X |
| 2,646,833 | 7/1953 | Meyers | 150/106 X |
| 2,682,290 | 6/1954 | Ditlea | 383/4 X |
| 2,778,397 | 1/1957 | Carrasco | 190/901 X |
| 2,819,776 | 1/1958 | Balsam | 383/4 X |
| 3,830,348 | 8/1974 | Ohyama | 190/107 |
| 4,011,898 | 3/1977 | Hobbard | 383/4 X |
| 4,703,519 | 10/1987 | Krenzel | 190/903 X |
| 4,782,874 | 11/1988 | Chartier | 383/2 X |
| 5,105,338 | 4/1992 | Held | 190/903 X |

FOREIGN PATENT DOCUMENTS

| | | | |
|---|---|---|---|
| 58258 | 8/1937 | Norway | 150/106 |
| 85830 | 3/1936 | Sweden | 120/117 |
| 351371 | 2/1961 | Switzerland | 383/2 |
| 582496 | 12/1976 | Switzerland | 383/2 |
| 681522 | 10/1952 | United Kingdom | 383/2 |

*Primary Examiner*—Sue A. Weaver
*Attorney, Agent, or Firm*—Nixon & Vanderhye

[57] ABSTRACT

A folding bag has a sack of a soft yielding material. The bottom of the sack is fastened to two half-shells of a semirigid material, connected through hinges of the film-type and a junction plate also in a semirigid material and is provided with a zipper. The half-shells can be arranged side by side to form a reinforced base for the sack and can close one over the other to form a case that can hold the sack when folded.

10 Claims, 3 Drawing Sheets

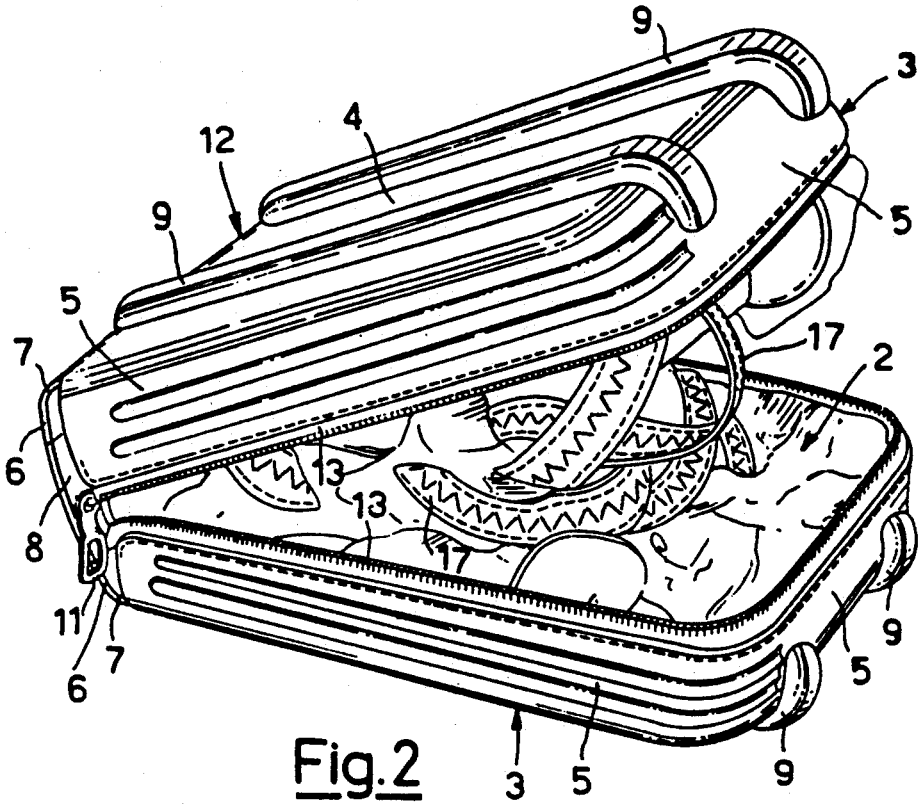
Fig.2
Fig.4
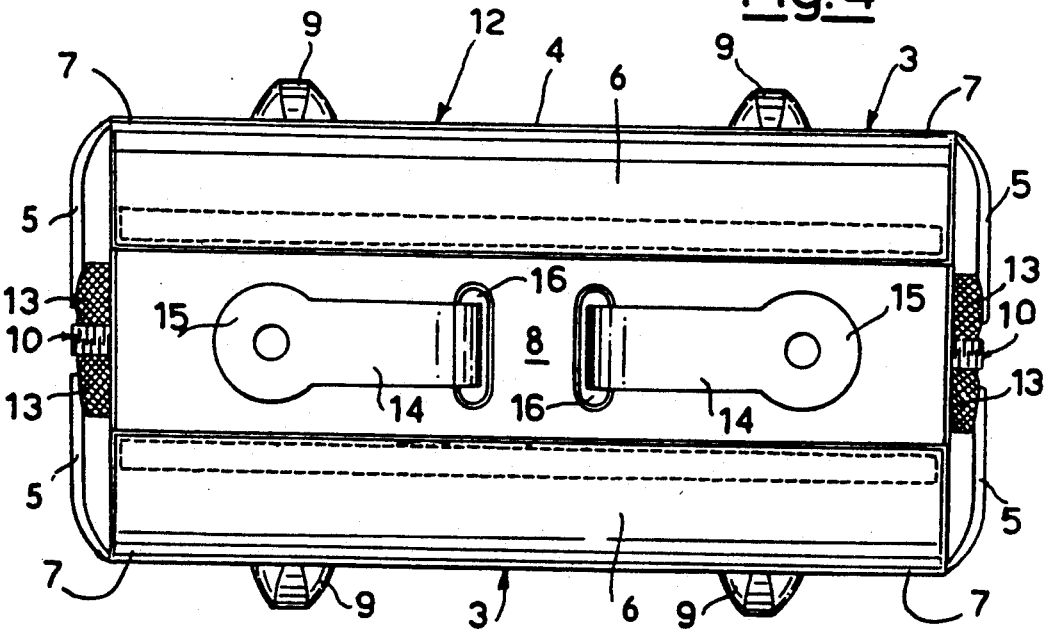

FOLDING BAG, PARTICULARLY TRAVELLING BAG

DESCRIPTION

The present invention relates to a folding bag, particularly a travelling bag, provided with a sack in a soft yielding material.

On several occasions, but especially during trips, it can be useful to have available a spare folding bag for use in case of need, for storing objects or garments purchased in the places visited.

Folding bags, especially travelling bags, exist on the market, made of a folding and pliable material, such as fabric, plasticized fabric, leather, that have the advantage of taking up very little space when they are folded. But these bags have the disadvantage of not being very strong and also somewhat inconvenient in use, because they are very yielding, especially for heavy objects having an irregular shape, or for objects that are easily deformed.

The object of the present invention is a folding bag that does not have the abovementioned disadvantages.

This object is attained with a folding bag, provided with a sack in a soft yielding material, characterized in that it comprises two half-shells of a semirigid material to which the bottom of said sack is integrally fastened. The half-shells are connected through hinges of the film-type and a junction plate also in a semirigid material and are provided with suitable closure means, so that said half-shells can be arranged side by side to form a reinforced base for the sack, when the bag is open, and can close one over the other by means of said closure means to form a case that can hold the folded sack, when the bag is closed.

According to a preferred solution the two half-shells have a substantially parallelepiped shape and are each formed by a bottom wall, by lateral walls and by a lateral flap detached from the same adjacent lateral walls and connected to, the bottom wall by means of one of the film-type hinges, the lateral flaps of the two half-shells being fastened to the junction plate.

Preferably the closure means are constituted by a zipper fastened to said half-shells, so that the same half-shells can close one over the other to form the abovementioned case.

According to a further solution straps are fastened to the sack to form handles supporting the bag and that preferably are in turn fastened to the half-shells.

Characteristics and advantages of the invention shall now be illustrated with reference to an embodiment shown as a non-limiting example in the enclosed drawings, wherein:

FIG. 2 is a perspective view on an enlarged scale of the bag of FIG. 1 partially folded;

FIG. 4 is a rear view of the bag of FIG. 3.

Figure 1:
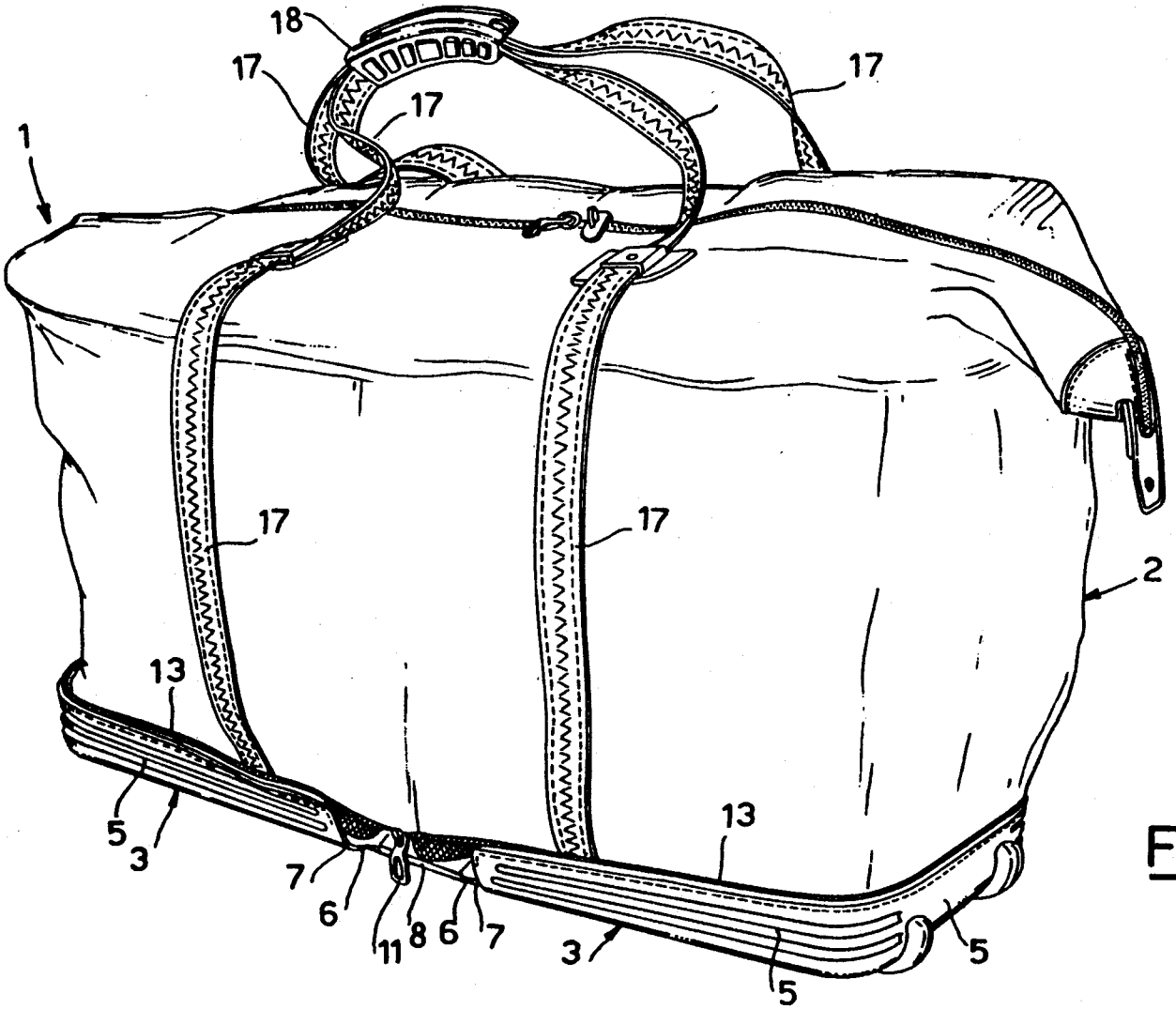
FIG. 1 is a perspective view of a bag manufactured according to the invention.
Figure 3:
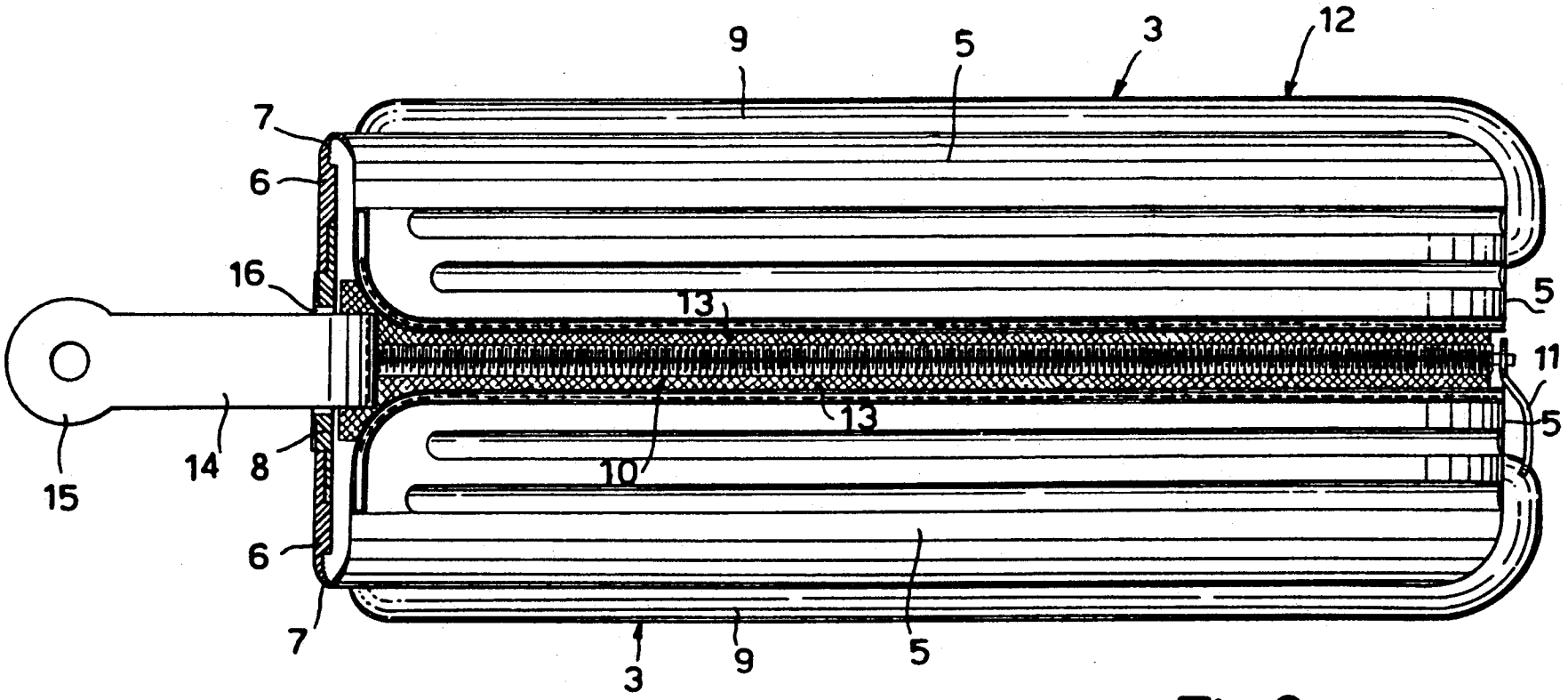
FIG. 3 is a partially-sectioned side view, on an enlarged scale of the bag of FIGS. 1 and 2 folded.

FIG. 1 shows in the condition of use a folding travelling bag, indicated as a whole by the reference numeral 1. The the bag 1 comprises a sack in a plasticized material, indicated as 2, whose bottom is fastened by means of a seam, or other suitable process, to two half-shells indicated as 3. As shown in FIGS. 2–4 the two half-shells 3 have a substantially parallelepiped shape and are each formed by a bottom wall 4 provided with reinforcing and supporting ribs 9, by lateral walls 5 and by a lateral flap 6 detached from the same adjacent lateral walls 5 and connected to the respective bottom wall 4 by means of a film-type hinge 7. The lateral flaps 6 are fastened to a junction plate 8 by means of a seam. The half-shells 3 and the junction plate 8 are made of semi-rigid material, for example, a suitable plastic material such as polythene, so as to form a reinforced base for the bag 1.

A zipper 10 as provided with two cursors 11. Cursory bands 13 supporting rows of teeth are fastened to the edge of the two half-shells 3 by means of the same seam which joins to them the bottom of the sack 2. To the extremities of the bands 13 there are fastened two tongues 14 slidable in two slots 16 made in the junction plate 8, in which they are held by respective tabs 15, that can be seen in FIGS. 3 and 4. By means of the hinge 7 the half-shells 3 can be closed one over the other and form a case 12 capable of containing the sack 2 when it is folded.

As shown in FIG. 1, there are fastened to the sack 2, by means of seams, straps 17, in turn fastened to the edges of the half-shells 3 by means of the same seam that joins to them the bottom of the sack 2; the straps 17 forming handles 18 for supporting the bag 1.

When the bag 1 is not in use, the sack 2 is folded inside the two half-shells 3 and the case 12 is closed through the zipper 10. The operation of closing the zipper 10 is made easier by the tongues 14 which are used to hold the extremities of the zipper 10. The tongues 14 are also used as handles for carrying the bag when the case 12 is closed.

When the bag 1 is to be used, the zipper 10 is opened, as shown in FIG. 2, and the half-shells 3 are arranged side by side, so that it is possible to extract the sack 2 and form a reinforced base for the same bag 1. During the opening operation the tongues 14 are held in the slots by the tabs 15, completely inside so that they do not completely re-enter completely inside the case 12.

As can be seen from the previous description the folding bag 1 is especially handy and functional because. Once open, the bag 1 becomes very capacious and having a base, formed by the two half-shells 3, that is strong and has a uniform shape, is suitable for containing even heavy objects having an irregular shape, or objects that are easily deformed. When it is folded, the sack 2 is easily held in the case 12 having a limited size, from which it can be extracted very easily.

I claim:

1. A travelling bag comprising:

a junction plate formed of a semi-rigid material;

two half-shell members formed of a semi-rigid material;

flexible hinges for connecting the two half-shell members to the junction plate whereby, when the travelling bag is in a closed position, the two half-shell members are pivoted toward one another about the flexible hinges and a case is thereby formed having a case interior cavity defined by the two half-shell members, the flexible hinges being parallel to one another;

closure means provided on the two half-shell members for closing the case formed when the travelling bag is in the closed position, the closure means comprising a zipper which engages peripheral portions of the two half-shell members;

a flexible sack attached to the two half-shell members whereby, when the travelling bag is in an open position, the junction plate together with two half-shell members opened about the flexible hinges form a reinforced base for the opened bag, and the flexible sack together with the reinforced base form a bag interior cavity, the flexible sack being fit in the case when the travelling bag is in the closed position;

at least one tongue attached to an extremity of the zipper, the tongue being slidably disposed in a slot provided in the junction plate, the tongue having a tab provided thereon, the tongue being narrower than the slot, the tab being dimensioned so that the tab cannot fit through the slot provided in the junction plate.

2. The bag of claim 1, wherein the two half-shell members have a substantially parallelpiped shape and are each formed by a bottom wall, lateral walls, and a lateral flap, the lateral flap being detached from adjacent lateral walls but connected to the bottom wall by the flexible hinge, the two half-shell members being connected to the junction plate by means of said flexible hinges and lateral flaps.

3. The bag of claim 1, wherein the zipper comprises zipper bands attached by a seam to the respective two half-shell members, and wherein the flexible sack member is attached to the two half-shell members by the same seam as are the zipper bands.

4. A travelling bag comprising:

a junction plate formed of a semi-rigid material;

two half-shell members formed of a semi-rigid material;

flexible hinges for connecting the two half-shell members to the junction plate whereby, when the travelling bag is in a closed position, the two half-shell members are pivoted toward one another about the flexible hinges and a case is thereby formed having a case interior cavity defined by the two half-shell members, the flexible hinges being parallel to one another;

closure means provided on the two half-shell members for closing the case formed when the travelling bag is in the closed position, the closure means comprising a zipper which engages peripheral portions of the two half-shell members;

a flexible sack attached to the two half-shell members whereby, when the travelling bag is in an open position, the junction plate together with two half-shell members opened about the flexible hinges form a reinforced base for the opened bag, and the flexible sack together with the reinforced base form a bag interior cavity, the flexible sack being fit in the case when the travelling bag is in the closed position; and straps fastened to the flexible sack, the straps forming handles for the bag when the bag is in the opened position, and wherein the straps are also fastened to the two-half-shell members.

5. The bag of claim 4, wherein the two half-shell members have a substantially parallelpiped shape and are each formed by a bottom wall, lateral walls, and a lateral flap, the lateral flap being detached from adjacent lateral walls but connected to the bottom wall by the flexible hinge, the two half-shell members being connected to the junction plate by means of said flexible hinges and lateral flaps.

6. The bag of claim 5, wherein the zipper comprises zipper bands attached by a seam to the respective two half-shell members, and wherein the flexible sack member is attached to the two half-shell members by the same seam as are the zipper bands.

7. A travelling bag comprising:

a junction plate formed of a semi-rigid material;

two half-shell members formed of a semi-rigid material;

flexible hinges for connecting the two half-shell members to the junction plate whereby, when the travelling bag is in a closed position, the two half-shell members are pivoted toward one another about the flexible hinges and a case is thereby formed having a case interior cavity defined by the two half-shell members, the flexible hinges being parallel to one another;

closure means provided on the two half-shell members for closing the case formed when the travelling bag is in the closed position, the closure means comprising a zipper which engages peripheral portions of the two half-shell members;

a flexible sack attached to the two half-shell members whereby, when the travelling bag is in an open position, the junction plate together with two half-shell members opened about the flexible hinges form a reinforced base for the opened bag, and the flexible sack together with the reinforced base form a bag interior cavity, the flexible sack being fit in the case when the travelling bag is in the closed position;

and wherein the zipper comprises zipper bands attached by a seam to the respective two half-shell members, and wherein the flexible sack member is attached to the two half-shell members by the same seam as are the zipper bands.

8. The bag of claim 7, wherein the two half-shell members have a substantially parallelpiped shape and are each formed by a bottom wall, lateral walls, and a lateral flap, the lateral flap being detached from adjacent lateral walls but connected to the bottom wall by the flexible hinge, the two half-shell members being connected to the junction plate by means of said flexible hinges and lateral flaps.

9. The bag of claim 7, further comprising straps fastened to the flexible sack, the straps forming handles for the bag when the bag is in the opened position.

10. The bag of claim 9, wherein the straps are also fastened to the two half-shell members.

* * * * *